US005136850A

United States Patent [19]

Bierschenk et al.

[11] Patent Number: 5,136,850

[45] Date of Patent: Aug. 11, 1992

[54] THERMOELECTRIC PAINT COLOR CHANGING APPARATUS

[75] Inventors: James L. Bierschenk, Rowlett; Edward J. Burke, Plano; Dwight A. Johnson, Lancaster, all of Tex.

[73] Assignee: Marlow Industries, Inc., Dallas, Tex.

[21] Appl. No.: 615,143

[22] Filed: Nov. 19, 1990

[51] Int. Cl.[5] ..... F25B 21/02

[52] U.S. Cl. ..... 62/3.62; 132/118; 62/3.3

[58] Field of Search ..... 62/3.1, 3.3, 3.62, 3.2; 132/118, 219, 148

[56] References Cited

U.S. PATENT DOCUMENTS

| | | | |
|---|---|---|---|
| 1,376,416 | 5/1921 | Forshee | 132/118 |
| 3,273,347 | 9/1966 | Elfving | 62/3.3 |
| 3,274,995 | 9/1966 | Eidus | 62/3.62 |
| 3,289,749 | 12/1966 | Crump | 62/3.62 |
| 3,971,229 | 7/1976 | Privas | 62/3.62 |
| 4,308,013 | 12/1981 | Major | 62/3.62 |
| 4,930,317 | 6/1990 | Klein | 62/3.3 |

*Primary Examiner*—Albert J. Makay
*Assistant Examiner*—William C. Doerrler

[57] ABSTRACT

An apparatus for generating cold and hot for application selectively by contact on an object having a paint or coating whose color changes in response to cold and hot temperatures. The apparatus is easy to hold and handle with one hand while holding an object for application, e.g., a doll or toy car, in the other hand. The apparatus includes a battery powered thermoelectric device having a cold sink shaped to form a cold applicator for cooling the paint sufficiently to change its color, and a heat sink shaped to form a heat applicator for changing back the color. For a doll, the cold sink applicator is used to change, for example, the natural color of the lips and cheeks to a make-up color, and a heat sink shaped to form a comb for combing the doll's hair and a heat applicator for returning the natural color of the doll's lips and cheeks through heat application.

6 Claims, 4 Drawing Sheets

THERMOELECTRIC PAINT COLOR CHANGING APPARATUS

This invention relates to thermoelectric cooling devices and more particularly to a thermoelectric cooling apparatus producing cold and hot for use in changing the color of an object whose color is temperature dependent.

BACKGROUND OF THE INVENTION

In the past objects such as dolls, toy cars, and cloth have been colored with a paint whose color is temperature dependent. The color of these objects has been changed by applying cold water to change a first color to a second color and hot water to return the first color to the object. Wash cloths and sponges have been used to apply cold and hot water to the object for color change. For convenience, handles have been attached to the sponges. Also tubular members having closed ends and opposing ends equipped with metal or plastic type applicators of a desired shape have been used to hold cold and hot water for cooling or heating the applicators for use in changing the color of the paint.

Several problems attend the use of cold and hot water. For example, when wash cloths or sponges or both are used as applicators an open container is required. Using the container often results in water spills or water messes which have to be cleaned up. While, water messes are alleviated with the use of tubular type applicators, the cold and hot water therein must be frequently changed to maintain operating temperatures. In some applications, for example, toy cars, cold and hot running taps have been used for changing the color. This is objectionable as the paint is damaged by intense heat.

With respect to the use of thermoelectric devices for generating cold and hot, they include thermoelements having opposing plates, typically, one plate constitutes the cold side for cooling an object in contact therewith and a hot side which is cooled to maintain the temperature difference essential for continued device operation. When it is desired to heat the object, the polarity is changed and the cold side then becomes the hot side.

A very small, light apparatus which is easy to handle in one hand is disclosed in U.S. Pat. No. 3,971,229 issued Jul. 27, 1976 to Yves Emile Privas for an "Apparatus For Producing Cold Principally For The Application Of Cold By Contact On The Body Of Living Beings. This apparatus includes a tubular cylindrical body closed at one end by a plug. The body includes a rechargeable battery adjacent to the plug end. A switch connects the battery to a thermoelectric element mounted with its cold face projecting through an aperture of a retaining cap. The retaining cap maintains the hot face in contact with a cylindrical heat sink which extends back into the tubular body. The applicator is either the actual surface of the cold face or an auxiliary surface which is thermally connected to the cold face. In this applicator, only one plate is available for applying cold to an object. This patent also recognizes that a cold face and a hot face of a thermoelectric element can be used simultaneously for a toy which combines a refrigerator and stove hot plate toy. However, there is no teaching or suggestion that the cold applicator could be modified to provide cold and hot applicators.

SUMMARY OF THE INVENTION

Accordingly, it is an object of the present invention to provide an apparatus for producing simultaneously cold and hot for use in changing the color of a device whose color is determined by a temperature sensitive paint.

Another object of the invention is to provide an apparatus for producing cold and heat sufficient for use in changing the color of a heat sensitive paint without damaging the paint.

Still another object of the invention is to provide an apparatus suitable for changing the color of a heat sensitive paint while alleviating the messes attending the use of devices utilizing cold and hot water as their temperature sources.

Yet another object of the invention is to provide an apparatus having a simultaneous cooling and heating production capability which is compact and light in weight; thus easy to handle with one hand while holding an object to be heated or cooled in the other hand.

A further object of the invention is to provide a thermoelectric apparatus having a hot probe for applying heat to an object such as a doll for changing its color, and a comb for combing its hair, the hot probe and comb providing a heat sink for dissipating heat from the apparatus.

Briefly stated the hand held apparatus of the present invention includes a battery powered thermoelectric device in a tubular cylinder. The sinks of the cold and hot faces of the thermoelectric device are arranged to produce substantially simultaneously cold and hot applicators for selective use. In another embodiment the heat sink of the hot face also forms a comb for combing, for example, a doll's hair., thus, adapting the apparatus for not only changing the color of a doll to simulate make-up but also for combing the hair of the doll.

BRIEF DESCRIPTION OF THE DRAWINGS

Other objects and features of the invention will become more readily apparent from the following detailed description when read in conjunction with the accompanying drawings, in which.

DETAILED DESCRIPTION OF A PREFERRED EMBODIMENT

Figure 1:
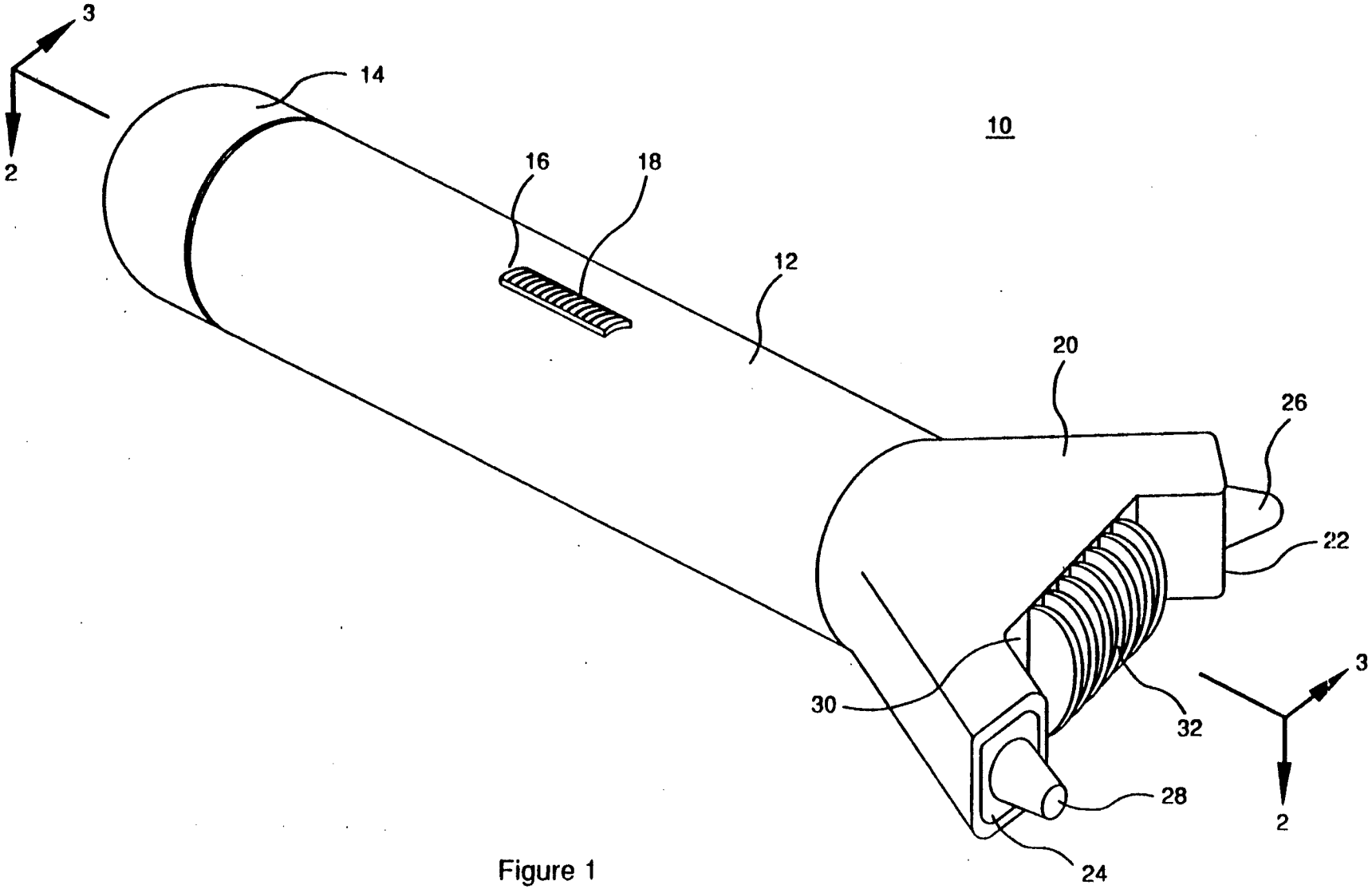
FIG. 1 is an isometric view of the hot and cold applicator apparatus constituting the subject matter of the present invention.

Referring now to FIG. 1, the apparatus 10 for applying cold and heat to an object painted with temperature dependent color paint includes for a first embodiment a housing having a tubular cylindrical body portion 12 closed at one end by a removable cap 14. The body portion 12 includes a centrally located aperture 16 through which protrudes a switch activating member 18 and an open end opposite the capped end which is adapted to receive a housing 20. The housing 20 is a bifurcated housing for providing spaced outlets 22 and 24 for cold and hot applicator tips 26 and 28. The cold applicator tip 26 can be the actual cold sink of a thermoelectric element or it could be a cold mass of molded material cemented to the actual cold sink. Similarly, the hot applicator tip 28 can be formed of the actual heat sink or of a mass of molded material cemented to the actual heat sink.

In a second embodiment, the apparatus of the first embodiment further includes an aperture 30 between the bifurcations of the housing 20. Either fins 32 of the heat sink extend through the aperture 30 of the housing or fins of a molded material attached to the heat sink extend through the aperture 30 to provide a heated comb.

Figure 2:
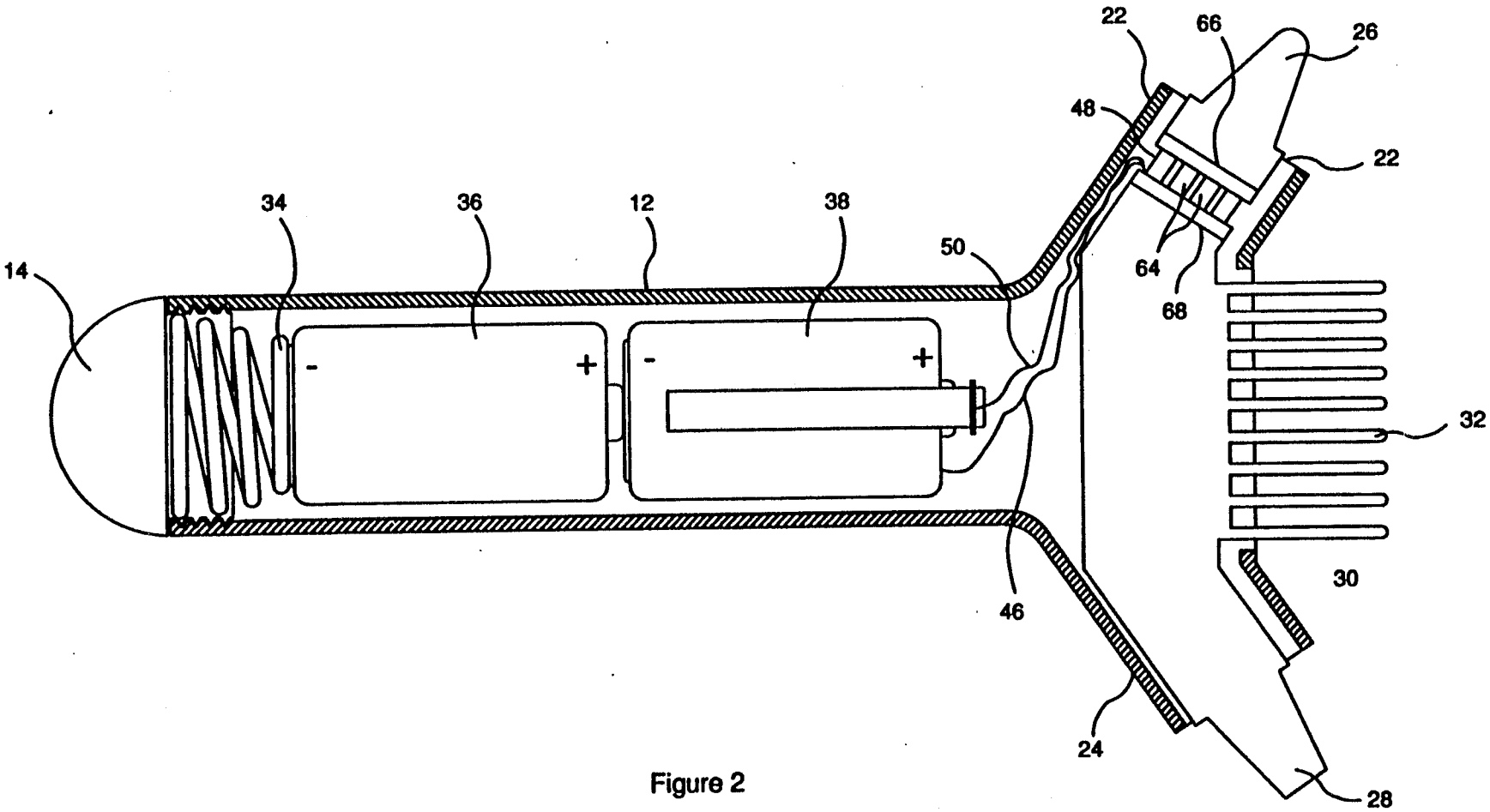
FIG. 2 is a cross sectional view of the apparatus taken along line 2—2 of FIG. 1.
Figure 3:
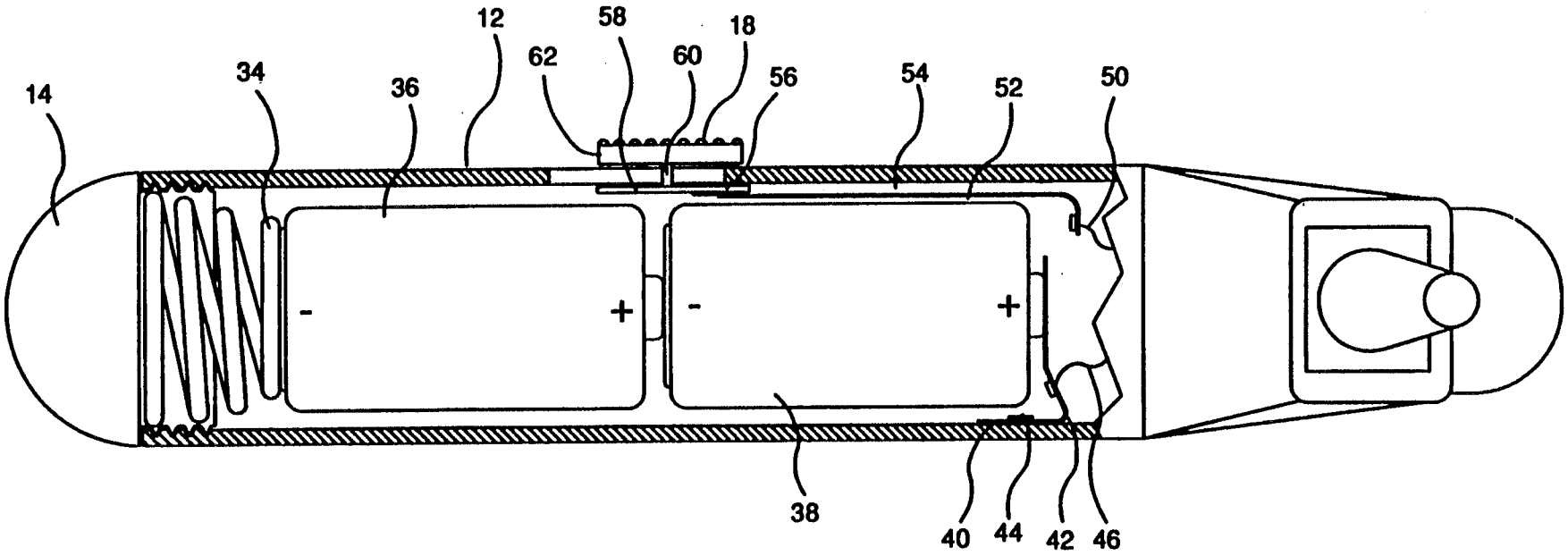
FIG. 3 is a cross sectional view of the apparatus taken along line 3—3 of FIG. 1.

Referring now to FIGS. 2 and 3, the removable cap 14 has a coil spring 34 for engaging the negative terminal of battery 36 for grounding batteries 36 and 38. The batteries are, for example, C batteries serially connected. The positive terminal of battery 38 is in electrical contact with a leaf type spring conductor 40 (FIG. 3). The spring conductor 40 is insulated from the housing 12 by a layer of insulation 42. The spring conductor and insulation layer are attached to the housing 12 by a connector 44 of insulating material. A lead 46 connects the positive terminal of battery 38 to the positive terminal of a thermoelectric device 48 (FIG. 2); while lead 50 connects the negative terminal of the thermoelectric device to a first end of a bar of conductive material 52 (FIG. 3). Conductor 52 has a body portion spaced from the housing 12 by an insulator 54 and a second end connected to a conductive plate 56.

Switch 18 (FIG. 3) includes a slidable plate conductor 58 connected by a spacer member 60 to a slidable actuating member 62. The plate conductor 58 being connected to the switch actuating member 62 moves therewith to engage the conductive plate 56 and housing 12 to close the circuit to the thermoelectric device 48.

Figure 4:
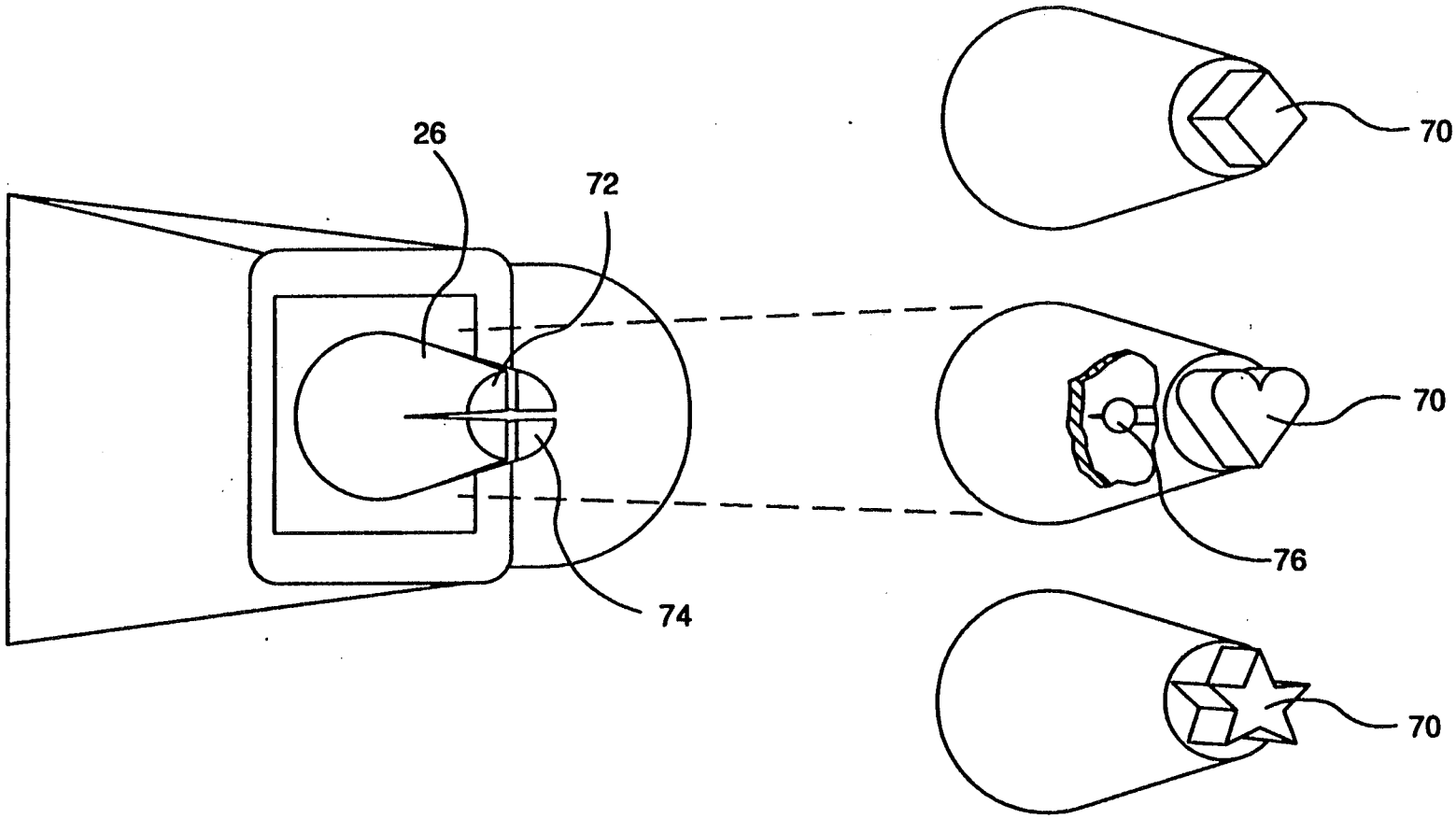
FIG. 4 is a partial isometric view of a cold/heat sink adapted to receive a removable applicator with a design pattern.

The thermoelectric device 48 includes the thermoelectric elements 64 (FIG. 2) sandwiched between cold and hot plates 66 and 68. The cold sink 26 is attached to the cold plate and is shaped to form an applicator suitable for its intended purpose. For example, for use with dolls it may be dome shaped to color the lips, cheeks, fingernails, toenails and beauty marks. As shown in FIG. 4, the cold sink 26 or hot sink 28 or both are designed to receive attachment members 70 having different shapes or designs for producing desired color patterns. The heat sink 28 includes a mass having a first end attached to the hot plate 68, and a body portion connecting the first end to a second end. The second end has a desired shape for returning the original color of the object. The cold and hot sinks 26 and 28 (FIG. 4) have split ends 72 and 74 for receiving spreader members 76 in the ends of the attachment members. Thus, when the attachment members are attached to the cold or heat sinks the spreader members spread the cold and heat sinks to engage the sides of the attachment members. This secures the attachments in good thermal contact to the sinks.

In the second embodiment, the body portion of the heat sink mass is either provided fins shaped to form comb tines or with an attachment member for attaching comb forming fins. The heated comb forming fins provides heat for drying the doll's hair while combing. It will be appreciated by those persons skilled in the art that the rolls played by the cold and hot sinks may be reversed in changing the color of the color medium.

Although several embodiments of the invention have been described, it will be apparent to a person skilled in the art that various modifications to the details of construction shown and described may be made without departing from the scope of this invention.

What is claimed is:

1. A thermoelectric apparatus for generating simultaniously cold and hot for selective application to a medium whose color is responsive to cold and hot temperatures comprising:

a housing including first and second body portions, said first body portion having opposing first and second open ends and a switch actuating means; a power source means mounted in the first body portion in operative connection with the switch actuating means; and a removable cap means for selectively closing the first open end of the first body portion; and said second body portion having an open end for attachment to the first body portion and an opposing bifurcated end, a thermoelectric device mounted in a first branch of the bifurcated end, said thermoelectric device being operably connected to the dc power source and including a plurality of thermoelectric elements sandwiched between cold and hot plates, a cold sink means attached to the cold plate and extending through the first branch for producing an exposed cold end, and a heat sink means attached to the hot plate and extending from the first branch to a second branch and through the second branch for producing an exposed hot end in a spaced relationship to the cold end, whereby cold and hot ends are simultaniously provided for use in changing the color of the medium.

2. A thermoelectric apparatus according to claim 1 wherein the heat sink means includes fins having comb teeth shapes for forming a heated comb.

3. A thermoelectric apparatus according to claim 1 wherein the cold sink means includes a dome shaped portion to facilitate the cooling of desired areas to the medium.

4. A thermoelectric apparatus according to claim 1 wherein the exposed end of the heat sink means is dome shaped to facilitate the heating of desired areas of the medium.

5. A thermoelectric apparatus according to claim 1 wherein the cold sink means includes an attachment end portion, and a removable cold applicator for attachment to the attachment end portion, said cold applicator having a preselected design for cooling an area of the medium to produce or remove the preselected design.

6. A thermoelectric apparatus according to claim 1 wherein the heat sink means includes an attachment end portion, and a removable heat applicator for attachment to the heat sink attachment means, said heat applicator having a preselected design for heating an area of the medium to either produce or remove the preselected design.

* * * * *